US008623582B2

(12) United States Patent
Gonen et al.

(10) Patent No.: US 8,623,582 B2
(45) Date of Patent: Jan. 7, 2014

(54) TREATMENT FOR ENHANCING CRACK RESISTANCE OF ORGANIC PHOTOCONDUCTORS

(75) Inventors: Eran Gonen, Nir David (IL); Yossi Rosen, Sitriya (IL); Mark Sandler, Rehovot (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 1448 days.

(21) Appl. No.: 11/830,430

(22) Filed: Jul. 30, 2007

(65) Prior Publication Data

US 2009/0035689 A1 Feb. 5, 2009

(51) Int. Cl.
*G03G 5/04* (2006.01)

(52) U.S. Cl.
USPC ..... 430/130; 430/127; 430/132

(58) Field of Classification Search
USPC ..... 430/127, 130, 132, 133
See application file for complete search history.

(56) References Cited

U.S. PATENT DOCUMENTS

| | | | | |
|---|---|---|---|---|
| 3,578,445 | A * | 5/1971 | Elchisak et al. | 430/56 |
| 5,240,532 | A | 8/1993 | Yu | |
| 5,376,491 | A | 12/1994 | Krumberg et al. | |
| 5,508,790 | A | 4/1996 | Belinkov et al. | |
| 6,165,570 | A | 12/2000 | Shannon | |
| 6,232,028 | B1 | 5/2001 | Landa et al. | |

* cited by examiner

*Primary Examiner* — Janis L Dote

(57) ABSTRACT

A method of treating a photoconductor for enhancing crack resistance when it comes into contact with a liquid toner comprises bending a photoconductor sheet having a length and a width to a tube having an outer diameter and a length corresponding to the width of the photoconductor sheet with the photoconductive layer facing outward. The tube of the photoconductor sheet is then inserted into a cylinder having an inner diameter greater than the outer diameter of the tube and a length of at least the length of the tube of the photoconductor sheet. The treatment of the tube of the photoconductor sheet in the cylinder takes place by maintaining it in the cylinder at a temperature of from about room temperature to an elevated temperature. The tube of the photoconductor sheet is removed from the cylinder while it is at about room temperature.

16 Claims, 3 Drawing Sheets

TREATMENT FOR ENHANCING CRACK RESISTANCE OF ORGANIC PHOTOCONDUCTORS

FIELD OF THE INVENTION

The present invention relates to photoconductors and, for example, to organic photoconductors and a treatment for enhancing crack resistance thereof.

BACKGROUND OF THE INVENTION

Various types of organic photoconductors are known. Most organic photoconductors are susceptible to attack by organic solvents of the type used in liquid toner electrophotography and are therefore unsuitable for such applications. These photoconductors include those which dissolve in the solvents and others which are caused to crack as the result of exposure thereto when they are under stress, especially under tension.

U.S. Pat. No. 5,240,532 describes a process for treating a flexible electrostatographic imaging web including a base layer and a layer including a thermoplastic polymer matrix. The process comprises forming a at least a segment of the web with the base layer of the web facing inwardly into an arc having a curvature between about 10 millimeters and about 25 millimeters, heating at least the polymer matrix in the segment to at least the glass transition temperature of the polymer matrix and cooling the imaging member to a temperature below the glass transition temperature of the polymer matrix while maintaining the segment of the web in the shape of the arc.

U.S. Pat. No. 6,165,570 discloses a method of treating an electrostatographic imaging member web that includes a support substrate and at least one imaging layer formed; over the support substrate. The electrostatographic imaging member web can optionally include no anti-curling back layer. The web is bent into an arcuate shape and heated to a temperature above the glass transition temperature of the imaging layer, The imaging layer is then cooled while in the arcuate shape to a temperature below the glass transition temperature, forming a substantially stress-free imaging layer when conforming to the arcuate shape.

U.S. Pat. No. 6,232,028 describes a method of processing a photoconductor by bending the photoconductor with the photoconductive layer facing outward without subjecting the photoconductor to substantial external stress other by virtue of said bending; heat treating the bend; and allowing the bend to cool.

SUMMARY OF THE INVENTION

A method of treating a photoconductor for enhancing its crack resistance when it comes into contact with a liquid toner is provided which comprises bending a photoconductor sheet having a length and a width to a tube having an outer diameter and a length corresponding to the width of said photoconductor sheet with the photoconductive layer facing outward, inserting said tube of the photoconductor sheet into a cylinder having an inner diameter greater than the outer diameter of said tube and a length of at least the length of said tube of the photoconductor sheet, treating said tube of the photoconductor sheet in said cylinder by maintaining it in said cylinder at a temperature of from about room temperature to an elevated temperature; and removing said tube of the photoconductor sheet from said cylinder while said tube is at about room temperature.

According to another aspect, a method of treating a photoconductor is provided which comprises providing a photoconductor sheet having a length and a width and a base layer and a photoconductive layer, overlaying a protective sheet having a length of less than or about the length of the photoconductor sheet and a width wider than said width of the photoconductor sheet over said photoconductor sheet in registration, with the width extending over the width of said photoconductor sheet; bending all or part of the combination of said photoconductor sheet and said protective sheet to a tube with said protective sheet over the photoconductive layer facing outward, treating said tube of the photoconductor sheet by maintaining the tube at temperature of from about room temperature to an elevated temperatures; and maintaining said photoconductor sheet partly or totally in a tube configuration at about room temperature, until it is used.

According to a further aspect a method of imaging is provided wherein a photoconductor treated in accordance with the first aspect above is used for forming an electrostatic image thereon.

Other features are inherent in the methods disclosed or will be apparent to those skilled in the art from the following description of the embodiments and its accompanying drawings.

BRIEF DESCRIPTION OF THE DRAWINGS

Embodiments of the invention will now be described by way of example and with reference to the accompanying drawings, in which.

The drawings and the description of the drawings are of embodiments of the invention and not the invention itself.

DETAILED DESCRIPTION OF THE PREFERRED EMBODIMENTS

Figure 1:
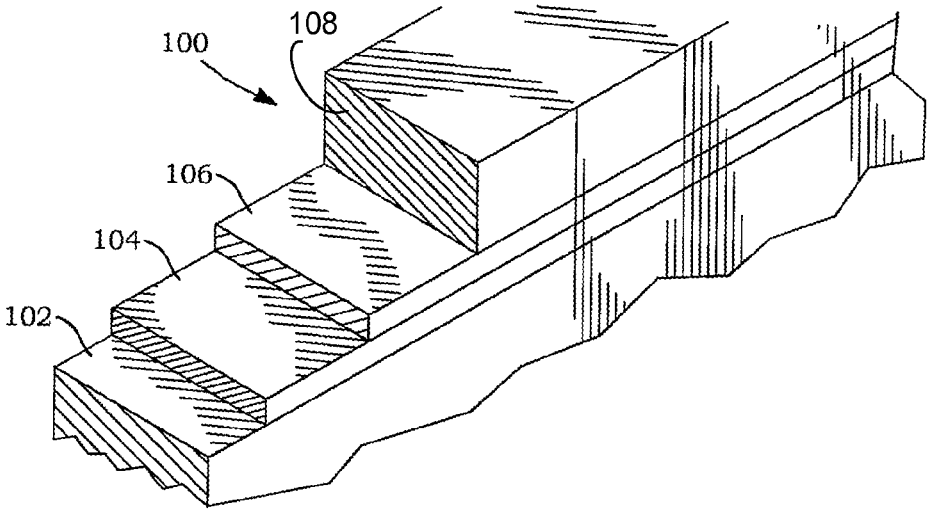
FIG. 1 shows a typical photoconductor used in some embodiments.

FIG. 1 illustrates a typical organic photoconductor sheet useful in the embodiments. This sheet photoconductor is useful e.g. in liquid toners systems in which the sheet is mounted on a drum. In such systems untreated photoconductors are susceptible to cracking when they are used with liquid toner, especially those utilizing a hydrocarbon carrier liquid such as Isopar® (a trademark of EXXON MOBIL Corp.). An example of such a system can be found in U.S. Pat. Nos. 5,376,491 and 5,508,790. However, cracking occurs also in other systems, and liquid toner systems are only illustrative for the systems with which the present photoconductors can be used. It must also be noted that the present photoconductors are not restricted to organic photoconductors, inorganic photoconductors and mixed inorganic and organic photoconductors can be used as well.

As shown in FIG. 1, an photoconductor sheet 100 according to some embodiments comprises a base layer 102 which in some embodiments is formed of aluminized polyethylene terephthalate (PET) commercially available e.g. under the trademark Mylar® from E. I. du Pont de Nemours & Company. The base layer in some embodiments may be about 75 to 80 microns in thickness and has a melting point of about 250° C. Other resins, such as other polyesters, polycarbonates, polyamides, polyurethanes, polysulfones, and the like which are thin flexible webs, may be used for the base layer. Thicknesses of less than 50 microns and up to e.g. 175 microns, in some embodiments of about 65 to about 150 microns, and in some other embodiments of about 75 microns to about 100 microns may be used in the base layer. Furthermore, metals other than aluminum can be used for the conductive coating of the resin layer, such as zirconium, niob, tantalum, vanadium and titanium, and the like, as well as conductive non-metallic materials, e.g. indium tin oxide.

Disposed above the base layer there may be provided an optional undercharge layer 104 which may be formed of, but without being limited thereto, polyester, polycarbonate, toluenesulfonamide-formaldehyde resin and polyamide having a thickness of 0.05 to 3 microns, particularly a thickness of about 0.2 microns. The undercharge layer 104 serves to bind the base layer 102 to the layer above the undercharge layer 104, i.e. the charge generating layer 106.

The charge generating layer 106 in an organic photoconductor may be formed of a hydroxysquarylium dye and toluenesulfonamide resin having a thickness of about 0.2 to about 0.3 microns. However, any charge generating layer 106 can be used in embodiments of the present photoconductors, such as e.g. selenium and selenium alloys, and other organic photoconductive particles including various phthalocyanine pigments. The binders include thermoplastic and thermosetting resins, such as polycarbonates, polyesters, polyamides, polyurethanes and the like. The thickness of the charge generating layer 106 may range from about 0.1 microns to about 5.0 microns.

Disposed above the charge generating layer 106 is a charge transport layer 108 which in some embodiments may be formed of polyester, polycarbonate yellow dye, 4-[N, N-diethylamino]benzaldehydediphenylhydrazone and poylsiloxane in a minor proportion, having a thickness of about 18 microns. Other aromatic amine compounds may be used, as well as other inactive matrix resin binders. Alternatively, the chare transport layer 108 may include electrically active resin materials, e.g. polymeric arylamine compounds, instead of mixtures of inactive resin materials with activating compounds. The thickness of the charge transport layer may be of from about 10 to about 50 micrometers. The charge transport layer 108 may also be sandwiched between the undercharge layer 104 or base layer 102 and the charge generating layer 106.

Charge transport layer 108 and charge generating layer 106 together define the photoconductive layer referred to above.

A photoconductor suitable for use with liquid toner is commercially available from IBM Corporation under the trade name Emerald.

In embodiments the photoconductor is subjected to a treatment for enhancing crack resistance.

Figure 2:
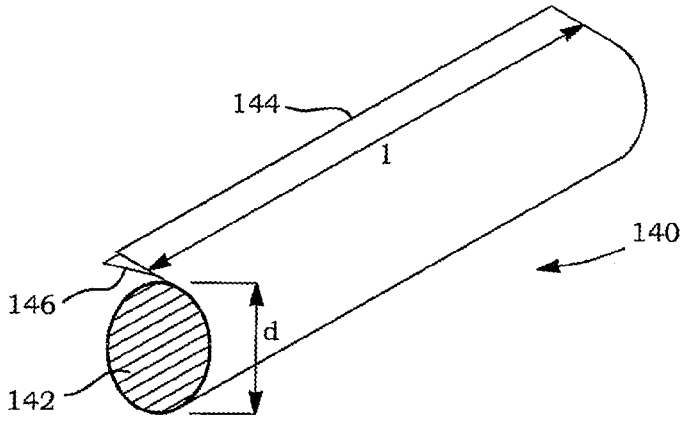
FIG. 2 shows a perspective view of a cylinder used in some embodiments.

As shown in FIG. 2, in one embodiment, a photoconductor sheet 146 that may have dimensions of 410×1220 mm or 410×650 mm or smaller is bent into a tube shape 140 with the photoconductive layer (106, 108) facing outward having a length 1 corresponding to the width of the photoconductor sheet 146. The outer diameter d of the tube 140 may vary widely, and is normally equal to or smaller than the drum onto which it will eventually be mounted. The outer diameter may range from about 28 mm to about 36 mm. In at least one embodiment, the tube of the photoconductor has an outer diameter of about 26 to about 36 mm and the cylinder has a diameter of about 28 mm to about 38 mm. The bending into the tube 140 may be accomplished by means of a roller 142 around which the photoconductor sheet 146 is wrapped. In at least one embodiment, the bending is accomplished by means of a roller remaining in the tube of the photoconductor until the combination of the roller and the tube has been inserted into the cylinder, whereupon the roller is removed from the tube. The tube of the photoconductor has a outer diameter of about 26 to about 38 mm and the cylinder has a diameter of about 28 mm to about 36 mm the cylinder being made of PC-ABS; and the treating is at about 70° C. to 75° C. for a period of time of from about 15 minutes to about 30 minutes and subsequently at about room temperature for up to about 4 months.

In one embodiment a protective sheet, shown as 144 in FIG. 2, is overlaid over the photoconductive layer of the photoconductor sheet 146. The protective sheet 144 has the same length as the photoconductor sheet 146 or a length slightly shorter, e.g. by 10 to 50 mm. The width of the protective sheet 144 is usually a little greater than the width of the photoconductor sheet 146, e.g. by 10 to 50 mm. The protective sheet is overlaid over the photoconductor sheet 146 in registration. The protective sheet 144 may be made of e.g. Tyvek™ (a fleece like material made of high density polyethylene fibers sold by Du Pont) or coated black paper; however, other materials are also conceivable. The protective sheet 144 normally has a textured surface so as to prevent "clinging" to the photoconductive layer of the photoconductor sheet 146. The combination of photoconductor sheet 146 and protective sheet 144 is then bent into a tube 140 with the protective sheet 144 over the photoconductive layer of the photoconductor sheet 146 facing outward. This bending may be assisted by means of a roller 142 around which the combination of photoconductor sheet 146 and protective sheet 144 is wrapped.

The advantage of having a protective sheet is that marks on the photoconductive layer that may originate from the leading and trailing end of the photoconductor sheet are minimized. This sheet also prevents any possible interactions between the inner wall of the cylinder and the photoconductive layer. Furthermore, by using a protective sheet, a unique stamp can be imprinted on the photoconductor sheet at a predetermined position.

Figure 3:
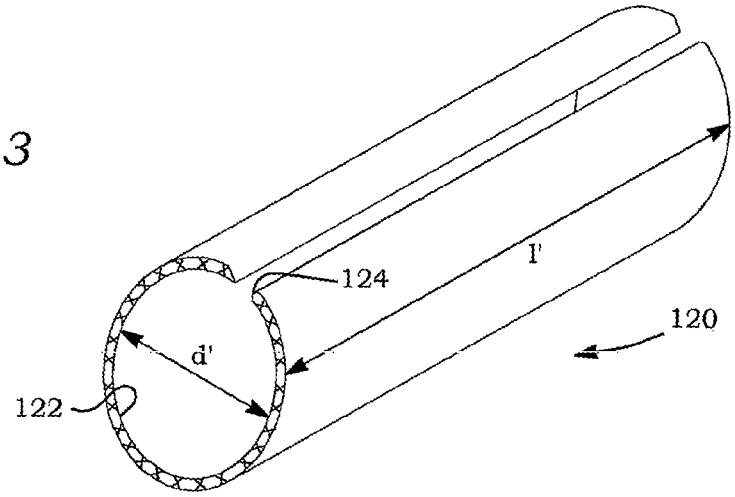
FIG. 3 shows a tube into which of a photoconductor is bent in some embodiments.

The tube 140 with or without the protective sheet 144 is then inserted into a cylinder 120, shown in a perspective view in FIG. 3, having an inner diameter d' of slightly greater than the outer diameter d of the tube 140, e.g. in some embodiments about 28 mm to about 38 mm. The tube 140 may be inserted while still wrapped around the roller 142, which is removed once the tube has been inserted into the cylinder. The cylinder has at least a length 1' corresponding to the length 1 of the photoconductor tube. The cylinder may be injection molded using of a relatively high-melting-point plastic material such as PC-ABS. Alternatively, the cylinder may be made of a metal such as aluminium. In some embodiments, the cylinder is made of a plastic material, including PC-ABS, having a melting point of above 110° C., and has a slot along its entire length.

As shown in the perspective view of FIG. 3, a cylinder 120 may have a slot 124, which extends along its entire length. The inner wall 122 of the cylinder 120 is very smooth. The tube 140, when introduced into the cylinder 120, is expanding slightly against the inner wall 122 of the cylinder 120 by which it is hold in its place.

The photoconductor tube 140 with or without the protective sheet is then treated by being maintained in the cylinder 120 at a temperature of from room temperature to an elevated temperature. By "room temperature" a temperature between about 20 and about 30° C. is meant, by "elevated temperature" a temperature of from about 30° C. to 100° C. or higher is meant. The higher the temperature is, the shorter is the treatment. At room temperature the treatment may be up to about 4 months, and at a temperature of 100° C. the treatment may be as short as 1 second or less. In some embodiments, the temperature of the treatment is from about room temperature to below the glass transition temperature Tg of the photoconductive layer. This treatment may be conducted at from room temperature to an elevated temperature for about 4 months to about 1 second. In some embodiments, this treatment may be conducted at from about room temperature to below the glass transition temperature Tg of the photoconductive layer for about 4 months to about 5 minutes. In at least one embodiment, this treatment may be conducted at about room temperature for a period of about 3 months to about 4 months. In some embodiments, the temperature of the treatment is from about room temperature to slightly below the glass transition temperature Tg of the photoconductive layer, or more precisely its polymer matrix, which may be about 75 to 80° C. In this case the time of treatment may be from up to about 4 months at about room temperature to about 5 minutes at slightly below the glass transition temperature after a warming-up period to reach this temperature. In one embodiment the photoconductor tube 140 with or without the protective sheet 144 in the cylinder 120 is heated to a temperature of about 70 to about 75° C. within about 40 minutes, at which temperature it is then maintained for a period of about 15 minutes to about 30 minutes, particularly about 20 minutes. In at least one embodiment, this treatment is conducted at about 70° C. to 75° C. for a period of time of from about 15 minutes to about 30 minutes after a warming-up period of about 40 minutes and subsequently at about room temperature for up to about 4 months. Then the cylinder 120 and the tube 140 are allowed to return to room temperature where they are left up to 4 months or until the photoconductor is used.

Figure 4:
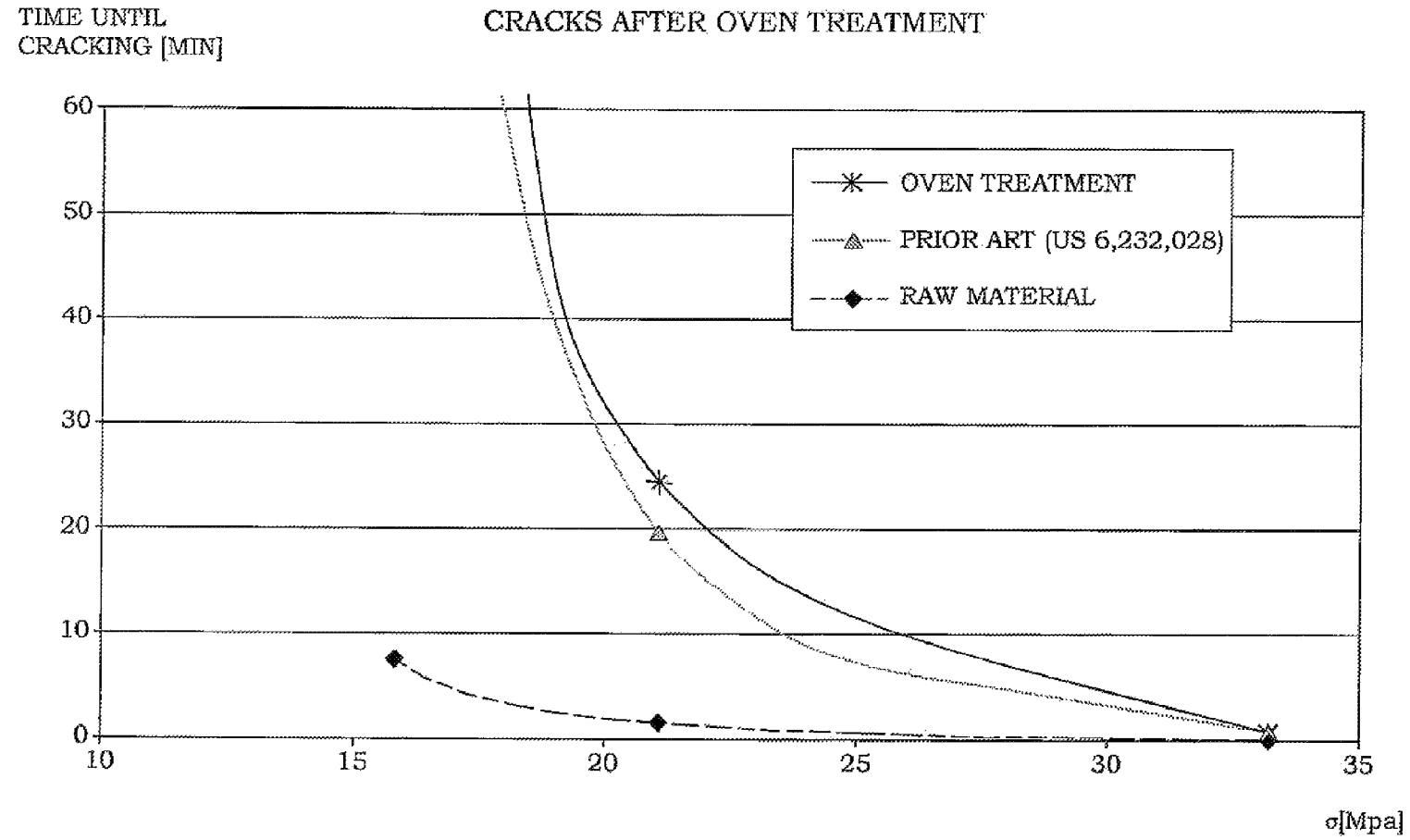
FIG. 4 is a graph plotting the values from three different photoconductors and which shows the time until cracking over an applied stress. The three photoconductors are: an organic photoconductor inside a cylinder which was given an oven treatment at 75° for about 20 minutes and was then left inside the cylinder for about 10 days, of a photoconductor treated according to the prior art (U.S. Pat. No. 6,232,028) and a photoconductor raw material.

The result of such a treatment is shown in FIG. 4. With an applied stress (σ) of about 22 MPa the time until cracking occurs is about 25 minutes. This compares favourably to the value of prior art (U.S. Pat. No. 6,232,028) of about 19 minutes and is much better than the value of the raw photoconductor material of about 2 minutes.

In another embodiment the photoconductor tube 140 with or without the protective sheet 144 is left in the cylinder 120 at room temperature for about 3 to about 4 months.

Figure 5:
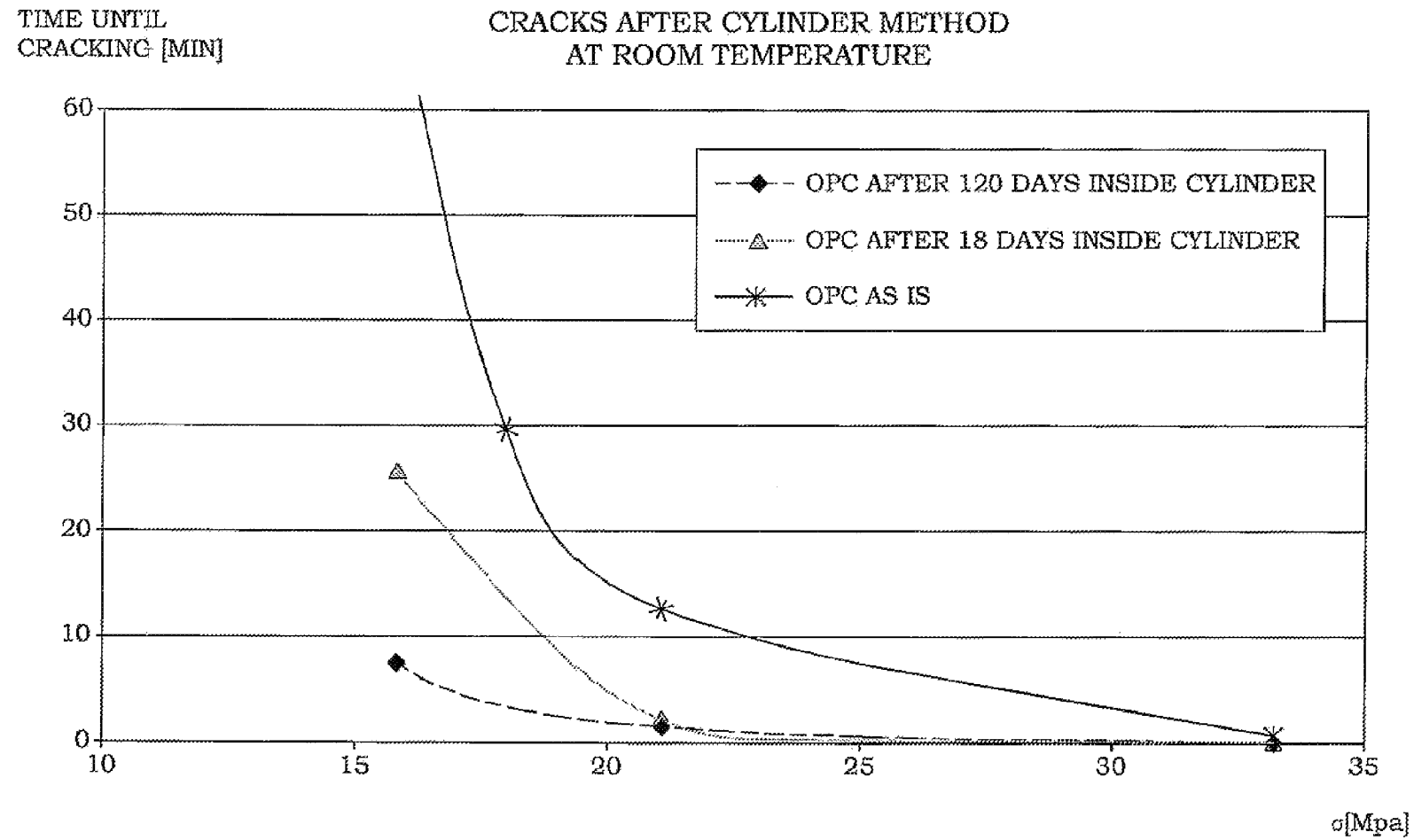
FIG. 5 is a graph which shows the time until cracking occurs vs. an applied stress, with regard to one organic photoconductor (OPC) after 120, another after 28 days inside a cylinder at room temperature, and to an OPC as it is.

The results are shown in FIG. 5. Already after 18 days inside the cylinder at room temperature the time until an organic photoconductor (OPC) cracks is about 25 minutes at a stress (σ) of about 17 MPa. After 120 days the time until cracking at a stress of about 18 MPa is about 29 minutes, whereas the time until cracking of the OPC as it is (untreated) is about 8 minutes.

During the treatment both ends of the cylinder may be sealed by a suitable means, such as a metal foil or cap or a plastic closing means. The slot may also be covered by a similar means. The possibility of not having to work in an externally clean environment by creating the clean environment inside the cylinder is a great advantage over the prior art where a clean external environment is always required.

A further embodiment comprises overlaying a protective sheet 144 on a photoconductive layer of a photoconductor 146 as described above and bending the combination of the photoconductor sheet and the protective sheet at least partially into a tube 140 after which the tube is treated as described above with reference to the embodiments involving the cylinder. In this case the tube has to be held together by a fastening means such as a ribbon or a tape. The protective sheet minimizes the marks imprinted into the photoconductive layer by the ribbon or tape. This embodiment is advantageous when a clean external environment, but no cylinder is available.

All the specific embodiments described above with respect to temperature and time of treatment also apply to this embodiment.

In all of the above embodiments the photoconductor sheet after the treatment has a defined curvature which makes it suited to be mounted on a drum.

The photoconductor may be cut to the desired size after the treatment.

Another embodiment is a method of imaging wherein the photoconductor treated according to the embodiment involving the cylinder is used for forming an electrostatic image thereon. The method may further comprise mounting the photoconductor on a drum, and after the electrostatic image has been formed, developing the electrostatic image with a liquid toner to form the developed image, and transferring the image to a final substrate.

The drum may have a diameter equal to or greater than the treated photoconductor.

All publications and existing systems mentioned in this specification are herein incorporated by reference.

Although certain methods in accordance with the teaching of the invention have been described herein, the scope of the specification and the appended claims is not limited thereto. On the contrary, all embodiments of the teachings of the invention fairly falling within the scope of the appended claims either literally or under the doctrine of equivalents are intended to be covered.

What is claimed is:

1. A method of treating a photoconductor having a base layer and a photoconductive layer comprising:

bending a photoconductor sheet having a length and a width to a tube having an outer diameter and a length corresponding to the width of said photoconductor sheet with the photoconductive layer facing outward, inserting said tube of the photoconductor sheet into a cylinder having an inner diameter greater than the outer diameter of said tube and a length of at least the length of said tube of the photoconductor sheet, treating said tube of the photoconductor sheet in said cylinder by maintaining it in said cylinder at a temperature of from about room temperature to an elevated temperature; and removing said tube of the photoconductor sheet from said cylinder while said tube is at about room temperature.

2. The method of claim 1, comprising:

overlaying a protective sheet having a length of less than or about said length of the photoconductor sheet and a width wider than said width of the photoconductor sheet over the photoconductive layer of said photoconductor sheet in registration, with the width of the protective sheet extending beyond the width of said photoconductor sheet before bending the combination of said photoconductor sheet and said protective sheet to a tube with said protective sheet over said photoconductive layer facing outward;

treating said tube of the photoconductor sheet in said cylinder by maintaining it in said cylinder at a temperature of from about room temperature to an elevated temperature; and removing said tube of the photoconductor sheet from said cylinder while said tube of is at about room temperature.

3. The method of claim 2, wherein the temperature of the maintaining is from about room temperature to below the glass transition temperature Tg of the photoconductive layer.

4. The method of claim 3 wherein said maintaining is conducted for about 4 months to about 5 minutes.

5. The method of claim 2 wherein said maintaining at from room temperature to an elevated temperature is conducted for about 4 months to about 1 second.

6. The method of claim 2 wherein said maintaining is conducted at about 70° C. to about 75° C. for a period of time of from about 15 minutes to about 30 minutes after a warming-up period of about 40 minutes.

7. The method of claim 6 wherein said maintaining is conducted at about 70° C. to 75° C. for a period of time of from about 15 minutes to about 30 minutes after a warming-up period of about 40 minutes and subsequently at about room temperature for up to about 4 months.

8. The method of claim 2 wherein said maintaining is conducted at about room temperature for a period of about 3 months to about 4 months.

9. The method of claim 2, wherein said bending is accomplished by means of a roller remaining in said tube of the photoconductor until the combination of said roller and said tube has been inserted into said cylinder, whereupon said roller is removed from said tube;

said tube of the photoconductor has a outer diameter of about 26 to about 38 mm and said cylinder has an inner diameter greater than said outer diameter of said tube of the photoconductor; and said treating is at about 70° C. to 75° C. for a period of time of from about 15 minutes to about 30 minutes and subsequently at about room temperature for up to about 4 months.

10. The method of claim 1 wherein the temperature of the maintaining is from about room temperature to below the glass transition temperature of the photoconductive layer.

11. The method of claim 1 wherein said maintaining at from room temperature to an elevated temperature is conducted for about 4 months to about 1 second.

12. The method of claim 1, wherein said the tube of the photoconductor has an outer diameter of about 26 to about 36 mm and said cylinder has an inner diameter greater than said outer diameter of said tube of the photoconductor.

13. The method of claim 1 wherein the bending is accomplished my means of a roller remaining in said tube of the photoconductor until the combination of said roller and said tube has been inserted into the cylinder, whereupon the roller is removed from said tube.

14. The method of claim 1 wherein the said cylinder is made of a plastic material and has a slot along its entire length.

15. The method of claim 1 wherein the cylinder is sealed at both ends during said treating.

16. A method of treating a photoconductor comprising:

providing a photoconductor sheet having a length and a width and a base layer and a photoconductive layer, overlaying a protective sheet having a length of less than or about the length of the photoconductor sheet and a width wider than said width of the photoconductor sheet over the photoconductive layer of said photoconductor sheet in registration, with the width extending beyond the width of said photoconductor sheet;

bending all or part of the combination of said photoconductor sheet and said protective sheet into a tube with said protective sheet over the photoconductive layer facing outward, treating said tube of the photoconductor sheet by maintaining the tube at temperature of from about room temperature to an elevated temperature; and maintaining said photoconductor sheet partly or totally in a tube configuration at about room temperature until it is used.

* * * * *

UNITED STATES PATENT AND TRADEMARK OFFICE

CERTIFICATE OF CORRECTION

PATENT NO. : 8,623,582 B2
APPLICATION NO. : 11/830430
DATED : January 7, 2014
INVENTOR(S) : Eran Gonen et al.

It is certified that error appears in the above-identified patent and that said Letters Patent is hereby corrected as shown below:

In the Claims:

In column 7, line 6, in Claim 2, after “tube” delete “of”.

In column 8, line 7, in Claim 12, delete “said the” and insert -- the said --, therefor.

In column 8, line 12, in Claim 13, delete “my” and insert -- by --, therefor.

Signed and Sealed this
Seventeenth Day of June, 2014

Michelle K. Lee

Michelle K. Lee
*Deputy Director of the United States Patent and Trademark Office*